US005778601A

United States Patent [19]

Wu

[11] Patent Number: 5,778,601

[45] Date of Patent: Jul. 14, 1998

[54] PROTECTIVE DEVICE FOR A DOOR

[76] Inventor: I-Tsung Wu, No. 174, Chrang-An street, Pan-Chiao City Taipei Hsien, Taiwan

[21] Appl. No.: 711,615

[22] Filed: Sep. 10, 1996

[51] Int. Cl.[6] ..... E05B 11/00

[52] U.S. Cl. ..... 49/383

[58] Field of Search ..... 49/383, 384; 16/225, 16/250, 251; 160/40, 41

[56] References Cited

U.S. PATENT DOCUMENTS

| | | | |
|---|---|---|---|
| 1,626,844 | 5/1927 | Kuhn | 49/383 |
| 2,694,234 | 11/1954 | Roby et al. | 49/383 |
| 4,261,140 | 4/1981 | McLean | 49/383 |
| 5,359,812 | 11/1994 | Mayfield | 49/383 |

FOREIGN PATENT DOCUMENTS

| | | | |
|---|---|---|---|
| 2664936 | 1/1992 | France | 49/383 |
| 3153 of 1857 | | United Kingdom | 49/383 |

*Primary Examiner*—Jerry Redman
*Attorney, Agent, or Firm*—Pro-Techtor International

[57] ABSTRACT

The device relates to a protective device for a door, which on a vertical edge is connected to a frame by hinges and opens towards its back side, with a gap between the frame and that vertical edge of the door opening when the door is opened, the protective device comprising: a shield for covering the gap, having a vertical fixed edge close to the frame and a vertical gliding edge close to the front side of the door; a fixing device for hingedly mounting the shield at the fixed edge on the frame; and a guiding system for guiding the gliding edge of the shield along the front surface of the door when the door is opened or closed; wherein the gap between the frame and the door is always covered by the shield, such that injuries of persons caused by fingers or limbs pinched in said gap are prevented.

5 Claims, 6 Drawing Sheets

PROTECTIVE DEVICE FOR A DOOR

BACKGROUND OF THE INVENTION

1. Field of the Invention

The present invention relates to a protective device for a door that is hinged on a frame, particularly to a shield which covers the gap between the frame and the door next to the hinges, such that children or careless persons will have no chance to stick a finger into the gap and be injured.

2. Description of Related Art

As shown in FIGS. 1 and 2, ordinary doors open to one side. They are mounted on a frame by vertical hinges on one vertical edge and have a lock close to the opposite vertical edge. From the lock a bar extends into the frame, when the door is closed. The lock and the bar are moved by two handles, one on each side of the door. When the door is open, the only connection to the frame are the hinges. Between the frame and the door, next to the hinges, a gap opens along with the door. The farther the door opens the wider is this gap, finally reaching a considerable width, enough to accommodate the hand or the foot of a child. When the door is closed again, the hand or the foot inserted will be injured or broken.

SUMMARY OF THE INVENTION

An object of the present invention is to provide a protective device for a door with a shield of a suitable width which prevents persons from inserting a finger into the gap between the door and the frame, thus protecting them from being injured. The shield is mounted on the frame and glides against the surface of the door, completely covering the gap between the door and the frame, when the door is open.

A further object of the present invention is to provide a protective device for a door, wherein the shield has an elastic element, which keeps the shield close to the opening door and thus lets the gap between the door and the frame always covered.

The present invention can be more fully understood by reference to the following description and accompanying drawings, which form an integral part of this application.

DETAILED DESCRIPTION OF THE PREFERRED EMBODIMENT

Figure 1:
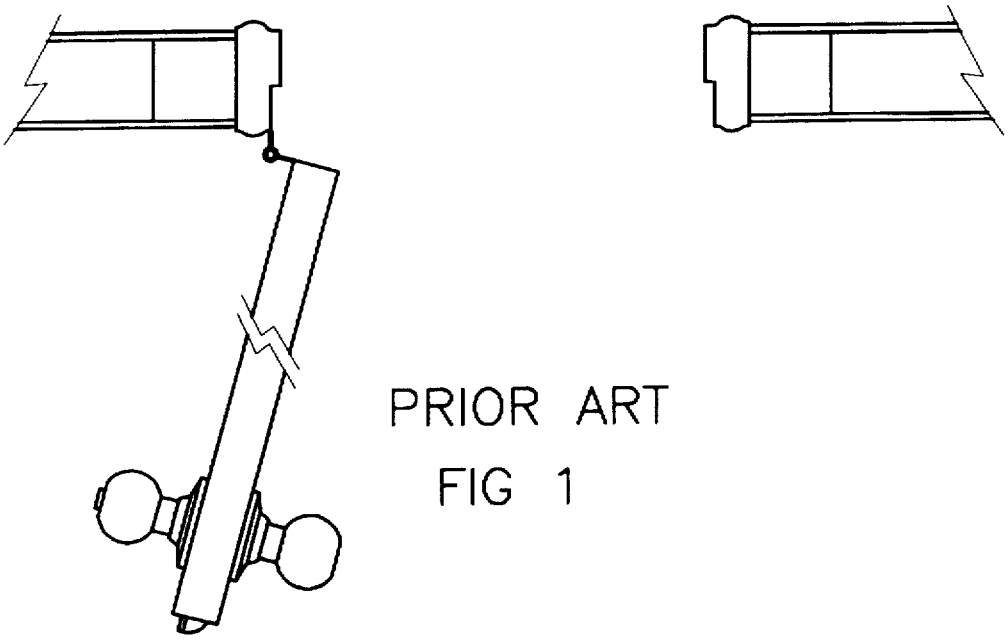
PRIOR ART FIG 1
FIG. 1 is a schematic illustration of a conventional open door.
Figure 2:
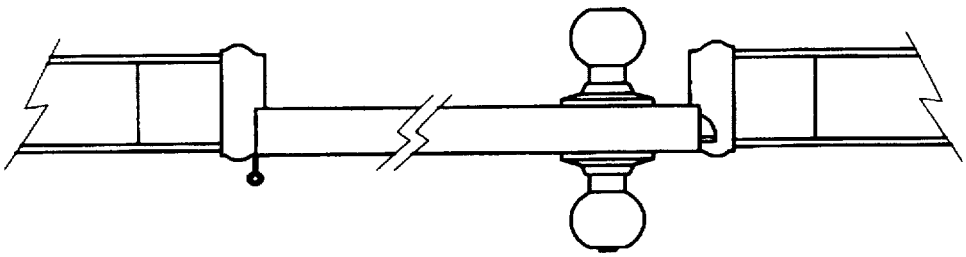
PRIOR ART FIG 2
FIG. 2 is a schematic illustration of a conventional closed door.
Figure 3:
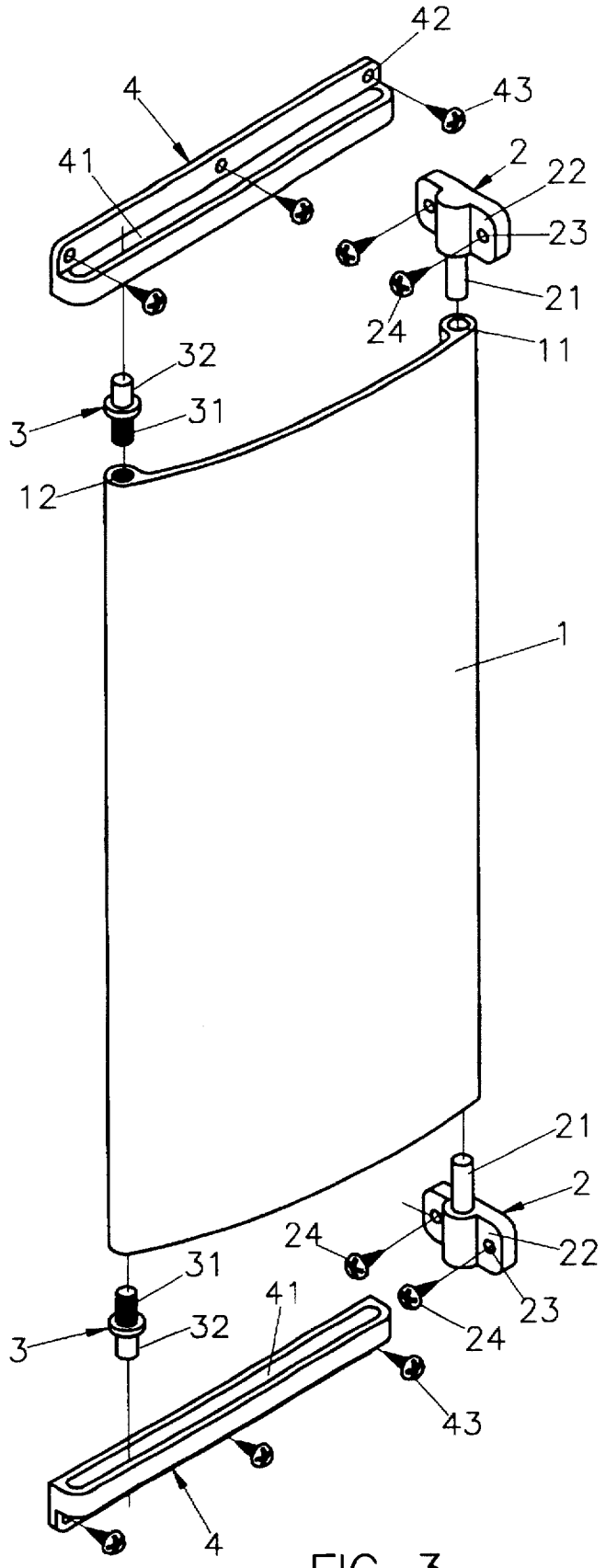
FIG. 3 is a perspective view of the present invention.
Figure 6:
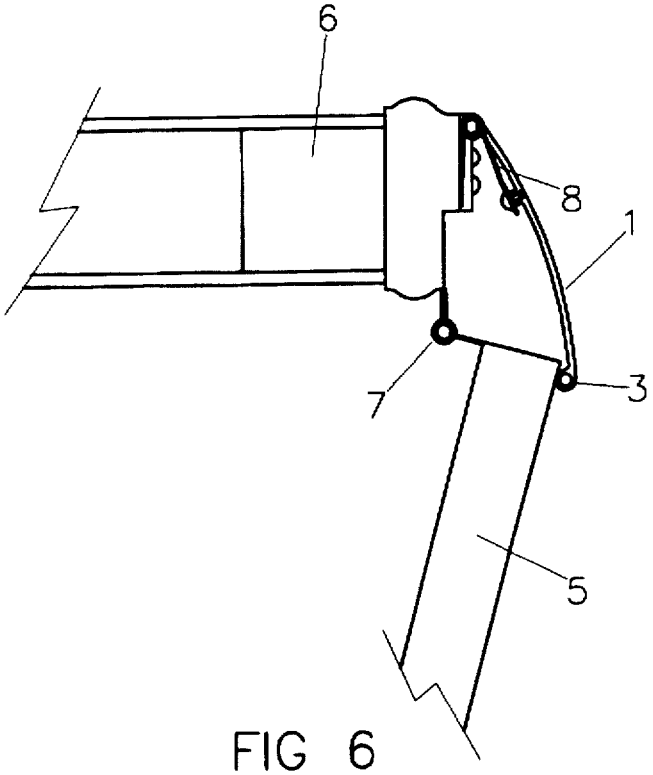
FIG. 6 is a sectional view of the present invention in a second embodiment in the open state of the door.
Figure 7:
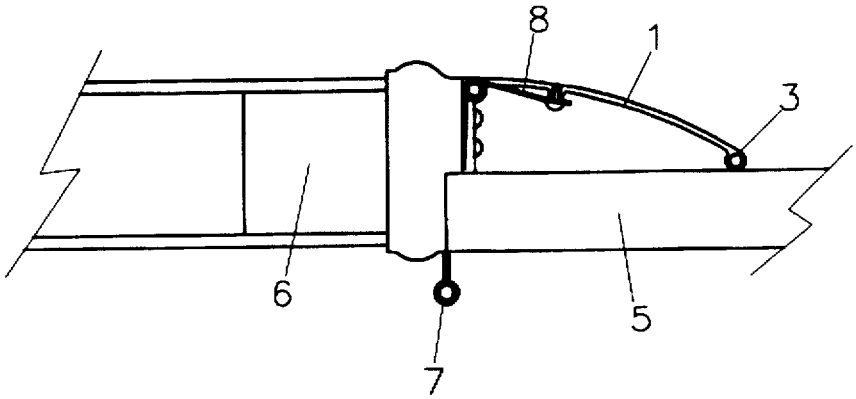
FIG. 7 is a sectional view of the present invention in a second embodiment in the closed state of the door.

Referring to FIGS. 3, 6 and 7, the present invention is a protective device for a door, mainly comprising a shield 1 with a fixed vertical edge and a gliding vertical edge, two fixing elements 2, and two gliding elements 3.

Figure 4:
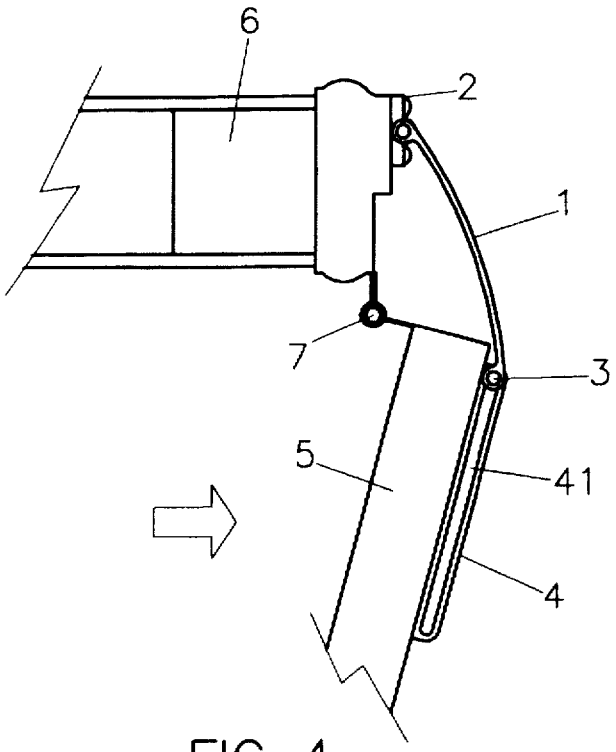
FIG. 4 is a sectional view of the present invention in a first embodiment in the open state of the door.
Figure 5:
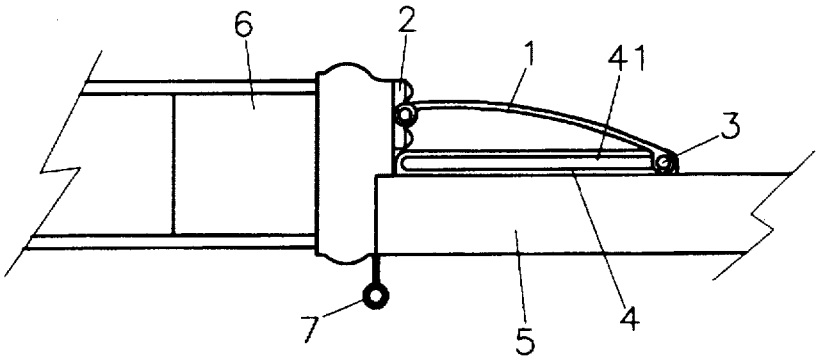
FIG. 5 is a sectional view of the present invention in a first embodiment in the closed state of the door.

Referring to FIGS. 3, 4 and 5, the door 5 has a front side and a back side. It opens towards the back side. One edge of the door 5 is connected to the frame 6 by hinges 7 that extend from the back side of the door 5. The shield 1 is on the fixed edge fixed to the frame 6. The shield 1 extends to the front surface of the door 5. At the fixed edge, the shield 1 has two holes 11, one bored from the top side and one bored from the bottom side. Each of the holes 11 holds one of the fixing elements 3. The two fixing elements 2 each have a bolt 21, which is glidingly inserted into one of the holes 11, and a fixing support 22. The fixing support 22 of each fixing element 2 is provided with two screw holes 23. Each fixing element 2 is fastened to the frame 6 by two screws 24 passing through the screw holes 23. The fixing elements 2 are fastened close to the contact surface of the frame 6 and the door 5.

At the gliding edge, the shield 1 has two threaded holes 12, one bored from the top side and one bored from the bottom side. Each of the holes 12 holds one of the gliding elements 3. Each of the gliding elements 3 has a threaded bolt 31, which is inserted into one of the holes 12 and held therein, and an insert part 32. Each insert part 32 is an extension of one of the threaded bolts 31 towards the outside of the corresponding hole 12.

On the front side of the door 5, close to the hinged edge, two horizontal guiding parts 4 are mounted at a suitable height, so as to guide the gliding parts 3. Each guiding part 4 has a pair of rails 41, the distance of which allows an insert part 32 to glide longitudinally in between. Each guiding part is further provided with fastening holes 42. Screws 43, passing through the fastening holes 42 fix the respective guiding part 4 on the door 5.

The shield 1 of the present invention may be a single plate or may consist of a plurality of plates.

Referring to FIGS. 6 and 7, the shield 1 of the present invention in another embodiment has an elastic element 8 with two ends. One end is attached to the frame 6, the other end is attached to the shield 1, close to the fixed edge thereof.

Referring to FIGS. 4 and 5, when the protective device for a door of the present invention is used, first the fixed edge of the shield 1 is fixed to the frame 6, then the gliding parts 3 on the gliding edge of the shield 1 are inserted in the space between the rails 41 of the guiding parts 4. When the door 5 is opened, a gap between the door 5 and the frame 6 opens. Then the gliding parts 3, as guided by the guiding parts 4, will slide back towards the hinged edge of the door 5, the gap between the door 5 and the frame 6 still being covered by the shield 1. When, on the contrary, the door 5 is closed, the gliding parts 3, as guided by the guiding parts 4, will slide away from the hinged edge of the door 5. Since the gap between the door 5 and the frame 6 is covered all the time by the shield 1, there is no chance for a child or an inadvertent person to get the fingers injured in the closing gap.

Referring to FIGS. 6 and 7, when the protective device for a door of the present invention in the other embodiment is used, first the fixed edge of the shield 1 is fixed to the frame 6, with the gliding edge in contact with the front surface of the door 5. When the door 5 is opened, a gap between the door 5 and the frame 6 opens. Then the gliding parts 3 will be kept in contact with the front surface of the door 5 by the elasticity of the elastic part 8 and will slide back towards the hinged edge of the door 5, with the gap between the door 5 and the frame 6 being covered by the shield 1. When, on the contrary, the door 5 is closed, the gliding parts 3, by the elasticity of the elastic part 8, will be pressed against the front surface of the door 5, sliding thereon away from the hinged edge. Since the gap between the door 5 and the frame 6 is covered all the time by the shield 1, there is no chance for a child or an inadvertent person to get the fingers injured in the closing gap.

Figure 8:
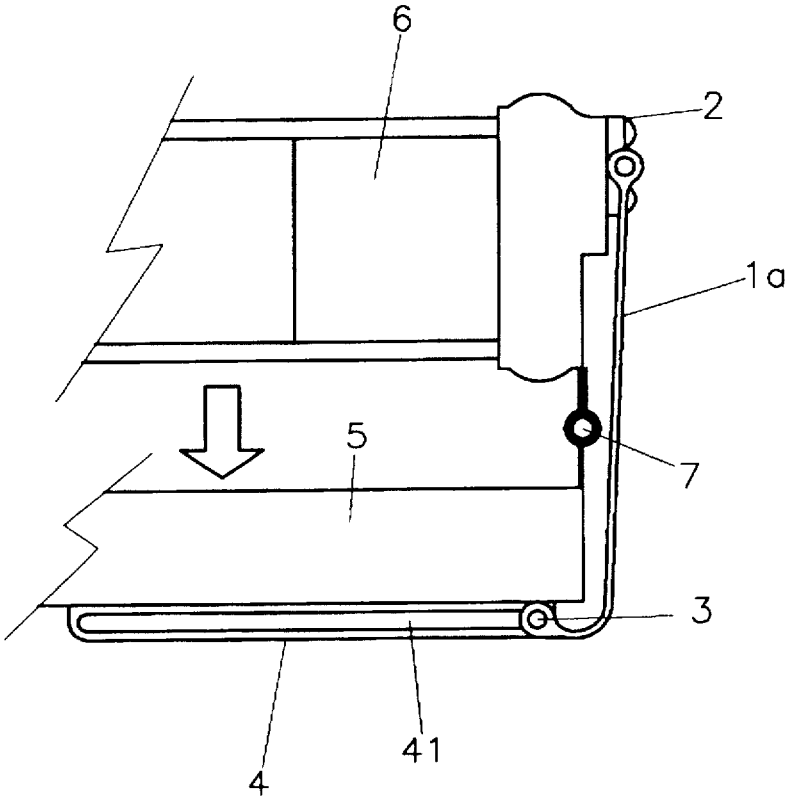
FIG. 8 is a sectional view of the present invention in a third embodiment in the open state of the door.
Figure 9:
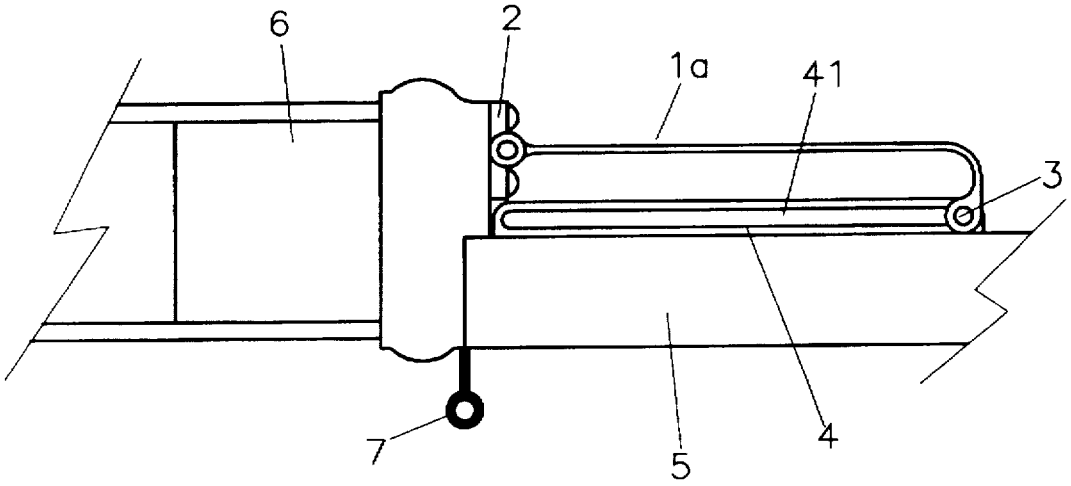
FIG. 9 is a sectional view of the present invention in a third embodiment in the closed state of the door.

Referring to FIGS. 8 and 9, the present invention in a third embodiment has a shield 1*a*, which is roughly shaped as an L, as viewed from the top, its gliding edge perpendicularly bent towards the front side of the door 5. Thus, when the door 6 is opened by an angle of 180°, the gliding elements 3 will glide towards the near end of the guiding elements 4, and the shield 1*a* will not interfere with the movement of the door 5.

Figure 10:
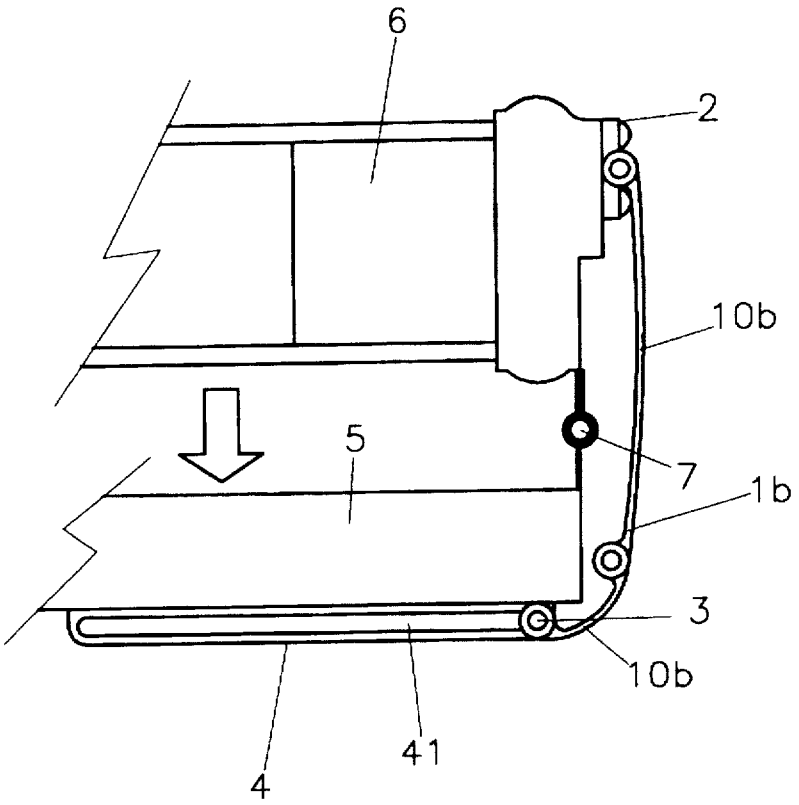
FIG. 10 is a sectional view of the present invention in a fourth embodiment in the open state of the door.
Figure 11:
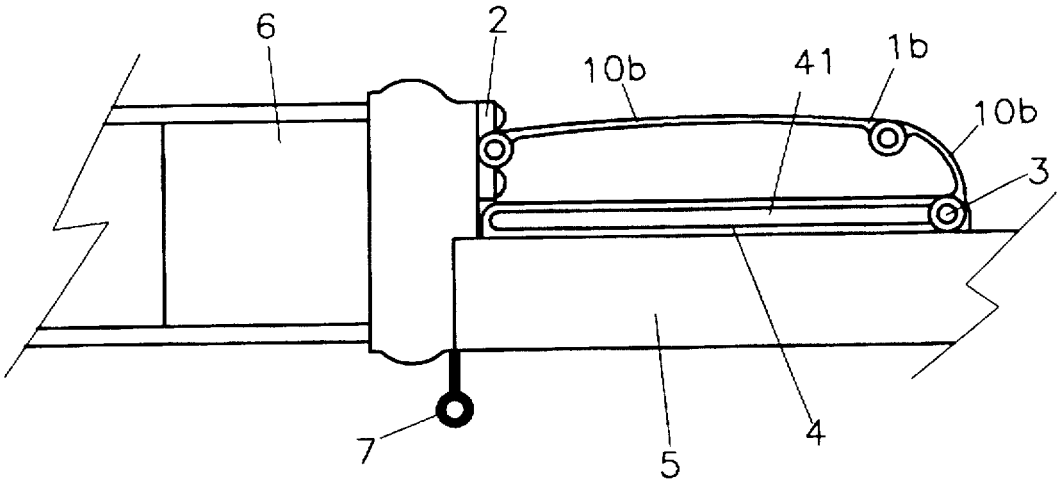
FIG. 11 is a sectional view of the present invention in a fourth embodiment in the closed state of the door.

Referring to FIGS. 10 and 11, the present invention in a fourth embodiment has a shield 1*b*, which is made up of a plurality of plates, which are on their vertical edges hingedly connected to each other. Thus, when the door 6 is opened by an angle of 180°, the plates of the shield 1*b* will be inclined against each other, and the shield 1*a* will not interfere with the movement of the door 5.

What is claimed is:

1. A protective device in combination with a door comprising:

a shield adapted to cover a gap between an edge of the door and a door frame, said shield having a vertical fixed edge in close proximity to the frame, and a vertical gliding edge in close proximity to a front side of the door, a width between said fixed edge and said gliding edge being larger than the maximum width of the gap;

a plurality of fixing elements attached to said frame, said fixed edge of said shield hinges on said fixing elements; and a guiding system for guiding said gliding edge of said shield, such that said gliding edge glides on a front side of the door when the door is opened or closed;

a plurality of gliding elements mounted on said gliding edge of said shield;

a plurality of guiding elements, each of said guiding elements having a pair of rails, each of said pairs of rails guiding one of said gliding elements, such that said gliding edge of said shield is kept close to the front side of the door; such that by always covering the gap with said shield, injuries caused by fingers or limbs being pinched in said gap are prevented.

2. A protective device according to claim 1, wherein:

said guiding system comprises an elastic element, which exerts an elastic force on said shield, pressing said gliding edge of said shield on the front side of the door.

3. A protective device according to claim 1, wherein:

said shield is a single plate.

4. A protective device according to claim 1, wherein:

said gliding edge of said shield is bent towards the front side of the door, such that said shield has an L-shaped cross-section.

5. A protective device according to claim 1, wherein:

said shield comprises a plurality of plates.

* * * * *